US005138222A

United States Patent [19]

Toide et al.

[11] Patent Number: 5,138,222

[45] Date of Patent: Aug. 11, 1992

[54] PROJECTION CATHODE RAY TUBE HAVING AN INTERFERENCE FILTER

[75] Inventors: Eiichi Toide; Shinsuke Shikama; Mitsushige Kondo, all of Nagaokakyo, Japan

[73] Assignee: Mitsubishi Denki Kabushiki Kaisha, Tokyo, Japan

[21] Appl. No.: 542,077

[22] Filed: Jun. 22, 1990

[30] Foreign Application Priority Data

Jun. 27, 1989 [JP] Japan ..... 1-164722
Aug. 18, 1989 [JP] Japan ..... 1-213589

[51] Int. Cl.[5] ..... H01J 29/28; H01J 29/89

[52] U.S. Cl. ..... 313/474; 313/112; 313/473; 358/73; 358/237; 358/253; 359/580

[58] Field of Search ..... 313/466, 473, 474, 112; 358/72, 73, 237, 253; 350/164

[56] References Cited

U.S. PATENT DOCUMENTS 4,310,784 1/1982 Anthon et al. ..... 313/474
4,634,926 1/1987 Vriens et al. ..... 313/474
4,642,695 2/1987 Iwasaki ..... 358/237
4,647,812 3/1987 Vriens et al. ..... 313/474
4,683,398 7/1987 Vriens et al. ..... 313/474
4,798,994 1/1989 Rijpers et al. ..... 313/112 X
4,804,884 2/1989 Vriens et al. ..... 313/474
4,831,307 5/1989 Takenaka et al. ..... 313/474 X

FOREIGN PATENT DOCUMENTS 0064348 5/1980 Japan ..... 313/473
1080203 4/1986 Japan ..... 350/164

*Primary Examiner*—Palmer C. DeMeo
*Assistant Examiner*—Ashok Patel

[57] ABSTRACT

A projection cathode ray tube has an interference filter which is disposed at a boundary between a face plate and fluorescent layers. The interference filter is designed to be thinnest at the central area of the CRT and to become gradually thicker toward the peripheral area of the CRT, so that the CRT can produce a uniformly bright image over the central and peripheral areas. The fluorescent layers include a first layer composed of small fluorescent particles and a second layer composed of large fluorescent particles. With this first fluorescent layer, light beams emitted by the second fluorescent layer can be prevented from being reflected in multiple directions, thereby minimizing halo due to such multi-direction reflection of the light beams.

11 Claims, 6 Drawing Sheets

PROJECTION CATHODE RAY TUBE HAVING AN INTERFERENCE FILTER

BACKGROUND OF THE INVENTION

1. Filed of the Invention

This invention relates to a projection cathode ray tube for producing an image to be projected onto a screen on an enlarged scale.

2. Description of the Background Art

FIG. 4 of the accompanying drawings shows a typical conventional video projector. As shown in FIG. 4, the video projector comprises a projection cathode ray tube (hereinafter called "CRT") 1, light sources 1R, 1G, 1B for producing red (R), green (G) and blue (B) color images, respectively, and a series of projection lenses 2. Reference numeral 3 designates a screen 3 disposed in front of the CRT 1. An image is projected from the CRT 1 onto the screen 3 via the projection lenses 2 so as to produce a large color image.

FIG. 5 is a cross-sectional view of the CRT 1, which comprises a vacuum envelope 4, an electron gun 5 mounted at a neck portion of the vacuum envelope 4, a face plate 6 of the vacuum envelope 4, and a fluorescent layer 7 formed on an inner surface of the face plate 6. On the fluorescent layer 7, a vacuum evaporation aluminum film 8 is formed as a high volt age electrode and a deflecting plate. In the CRT 1, the electron gun 5 produces electron beams to excite the fluorescent layer 7, which then becomes luminous.

The conventional video projector is advantageous in producing a large colored image. But, there have hitherto been demand not only for a larger image but also for a high quality image, particularly for a brighter and finer image.

First, the technique for brightening the image will be described. To obtain a brighter image, there has been proposed a CRT, in which an optical interference filter 14 is disposed at a boundary 11 (FIG. 6) between the face plate 6 and the fluorescent layer 7 so as to increase the transmittivity of light beams which are nearly perpendicularly (about +30°) incident on the face plate 6. This conventional technique is exemplified in Japanese Laid-open patent publication No. 207750/1983.

FIG. 8 shows a graph representing the spectroscopic transmittivity 12 of the interference filter 14 and the luminous spectrum of a green (G) fluorescent material. In FIG. 8, Θ stands for the angle at which the light beams fall on the face plate 6. The light beams, which fall nearly perpendicularly on the interference filter 14, have transmittivity of approximately 100%. The larger the incident angle, the greater the transmittivity is reduced, so that the light beams will be reflected. The reflected light beams will then be scattered and reflected again by the fluorescent layer 7 made of a high refractive index material. Subsequently, the reflected light beams will fall on the fluorescent layer 7 nearly perpendicularly.

FIG. 9(*a*) shows the distribution of beam intensity in the absence of any optical interference filter 14, while FIG. 8(*b*) shows the distribution of beam intensity in the presence of the interference filter 14.

The light beams as shown in FIG. 6 are emitted from the fluorescent material at the angle $\alpha_1$ which is within +30° at the central areas of the CRT screen. As a result, use of the interference filter is very effective to produce a very bright image.

As shown in FIG. 8, an emission spectrum of the green fluorescent material includes not only essentially needed spectrum (a) but also needless spectra (b) to (d). With the interference filter 14, it is possible to minimize the needless spectra (c) and (d) as seen from FIG. 7, thus improving saturation of the green color.

However, the conventional video projector using the interference filter is disadvantageous in that the image is very bright at the central area of the CRT while it is very dark at the peripheral area of the CRT.

In FIG. 6, $\Theta_2$ is an angle at which a chief light beam 17 in an effective bundle of beams is incident onto the face plate 6, and is usually about +30°. Also, since the angle $\Theta_2$ spreads over $+\alpha_2$, the transmittivity will be considerably reduced so that the image will be very dark at the peripheral areas.

In order to overcome the problem, a proposal has been made to curve the inner surface of the face plate, i.e., the boundary 11, as shown in FIG. 7. The curved face plate serves to reduce the incident angle $\Theta_2$ of the chief beam at the peripheral areas of the CRT compared with that of the flat face plate shown in FIG. 5, and also increase the brightness of the image at the peripheral area of the CRT.

Further, if the face plate 6 is of such a shape so that the incident angle $\Theta_2$ is zero (0), namely, if the normal 16 at the boundary 11 at the peripheral area of the CRT has a radius of curvature passing through the incident pupil position 15 of the projection lens 2, the interference filter 14 can make an image very bright over the central and peripheral areas of the CRT. Practically, however, it is very difficult to manufacture a CRT having a very small radius of curvature.

To sum up, the conventional projection CRT using the interference filter can produce a very bright image at the central area of the CRT, while it produces a dark image at the peripheral areas of the CRT because the light beams are incident onto the interference filter at a large angle, which reduces the transmittivity.

A method to improve fineness of the image will now be described. One of the main factors which hinder improving the fineness of the image is a glow observed around the luminous spot on the screen of the CRT, i.e., halo, which is caused by multiple reflection of the light beams (scattered beams).

The manner in which the halo is developed will be described with reference to FIG. 10 which shows the configuration of the fluorescent layer 7 of the CRT 1 illustrated in FIG. 5. Here the CRT 1 is a projection CRT (1G) producing green fluorescent beams. In FIG. 10, reference numeral 70 designates fluorescent particles, which are usually 8 to 20 μm in diameter. Light beams emitted from the aluminum film 8 excite fluorescent particles 70 to make them luminescent. Light beams passing through the boundary 11 between the face plate 6 and the fluorescent layer 7 reach the screen via the projection lens series not illustrated.

The light beams, for example from the fluorescent particle 70 that is indicated with oblique lines, are emitted in multiple directions. In the video projector, beams 9 directly passing through the boundary 11 are most intense and control the shape of a luminous spot. The intensity distribution of such light beams is indicated by a solid line in FIG. 11.

As shown in FIG. 10, light beams 10 are reflected by the boundary 11 and by the fluorescent layer, and some beams are reflected in multiple directions and then pass through the boundary 11.

These beams lo cause halo. The beam intensity of the luminous spot is indicated by a dot-line arrow in FIG. 11. The larger the luminous spot, the more of fineness the fineness of fineness of the image will be hindered.

If an interference filter 14 is mounted upon the face plate as illustrated in FIG. 7, as shown in FIG. 8 the transmittivity of light beams which are nearly perpendicularly incident onto the boundary 11 will be improved. However, larger the incident angle Θ, the lower the transmittivity and the larger the halo. In other words, the luminous spot in the presence of the interference filer 14 will become larger due to halo than in the absence of the filter 14.

As mentioned above, halo is caused by the light beams reflected on the boundary 11, and spreads over an area whose size depends mostly upon the size of vacuum gaps between the fluorescent particles 70 near the boundary 11. If the fluorescent particles are 8 to 12 μm in diameter, the gaps between the particles 70 are 10 to 20 μm. The diameter of the luminous spot affected by halo is about +10 to 20 μm. If the CRT has a luminous spot diameter of 200 μm, the spot diameter is increased by 10 to 20% due to halo.

To suppress halo, if the diameter of the fluorescent particles 70 is reduced to about 5 μm, the gaps between the fluorescent particles 70 will be about 5 μm near the boundary 11. This means that increase of the luminous spot diameter will be halved.

Small fluorescent particles, however, tend to be less luminescent and tend to reduce the brightness of the image from the video projector. Even if the fluorescent layer 7 is thicker to increase the number of fluorescent particles, the transmittivity will be reduced in the thickness direction of the fluorescent layer 7, resulting in a reduced brightness of the image.

SUMMARY OF THE INVENTION

It is therefore an object of this invention to provide a projection cathode ray tube which can produce a bright image over the central and peripheral areas on a screen, can suppress halo without reducing the brightness of the image, and can assure a high quality image.

According to an embodiment of this invention, there is provided a projection cathode ray tube having an interference filter which is thicker in its peripheral area than its central area so that the transmittivity of the chief light beam is not reduced over the whole area of the CRT. This interference filter also passes the chief beam from the peripheral areas of the CRT to pass therethrough without decreasing the transmittivity, so that a bright image can be obtained over the whole area of the CRT.

The projection CRT of this embodiment of the invention comprises a first fluorescent layer which is made of small fluorescent particles and is located near the face plate, and a second fluorescent layer which is made of large fluorescent particles which is located remote from the face plate. Gaps between the second fluorescent layer and the face plate are filled with the small fluorescent particles of the first fluorescent layer. The first fluorescent layer prevents the light beams, emitted from the large fluorescent particles of the second fluorescent layer, from being reflected in multiple directions between the first fluorescent layer and the boundary. Thus halo can be minimized halo.

The above and other advantages, features and additional objects of this invention will be manifest to those versed in the art upon making reference to the following detailed description and the accompanying drawings in which a preferred structural embodiment incorporating the principles of this invention is shown by way of illustrative example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION

Figure 1:
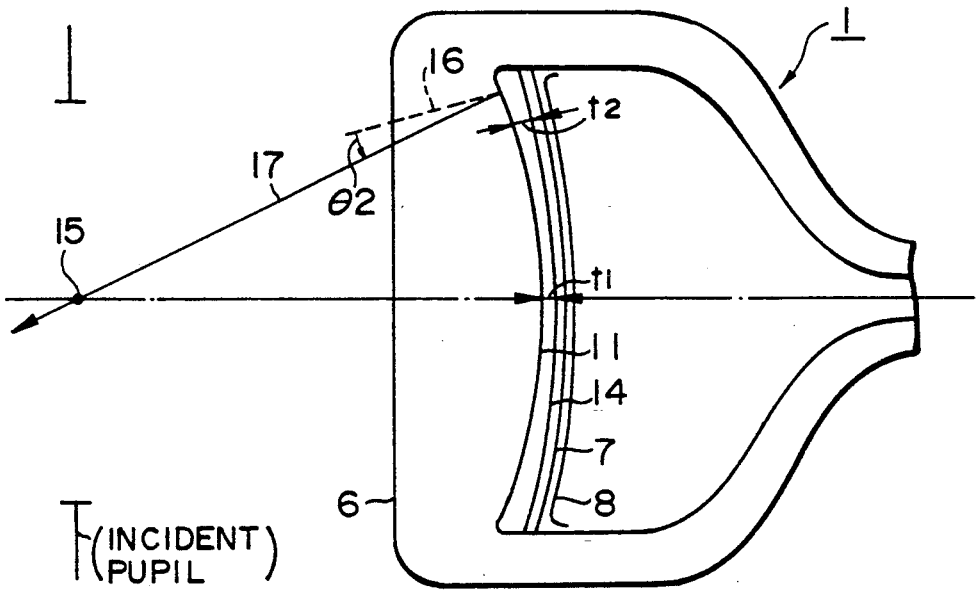
FIG. 1 is a cross-sectional view of a projection cathode ray tube embodying this invention.
Figure 2:
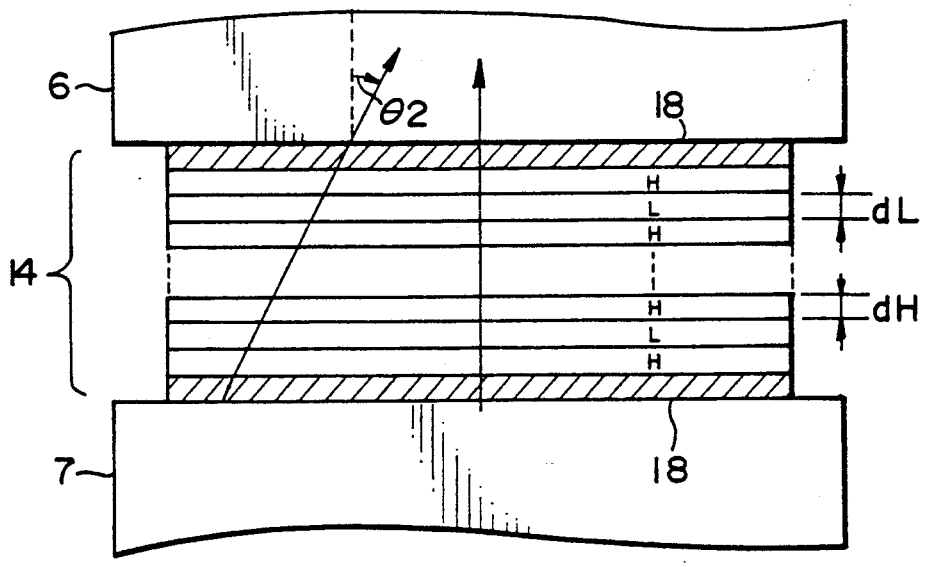
FIG. 2 is a cross-sectional view of an interference filter used in the embodiment shown in FIG. 1.

The principles of this invention are particularly useful when embodied in a projection cathode ray tube such as shown in FIGS. 1 and 2. In FIG. 1, reference numeral 14 designates an interference filter. The interference filter 14 has a thickness $t_1$ at the central area thereof and a thickness $t_2$ at the peripheral areas thereof, with $t_2$ being larger than $t_1$.

The thickness of the interference filter is determined as described below in connection with FIG. 2.

In FIG. 2, H stands for a fluorescent layer having high refractive index $n_H$; L, a fluorescent layer having low refractive index $n_L$; H (LH) N, a superimposed structure of H-layers and L-layers (N: the number of layers); $d_L$, a thickness of the fluorescent layer having low refractive index; and $d_H$, a thickness of the fluorescent layer having high refractive index. The H-layer and L-layers are alternately superimposed between a face plate 6 and a fluorescent layer 7 via regulating layers 18.

Designing of the central area of the interference filter will be described first.

The interference filter is formed similarly to the conventional interference filter.

To obtain spectroscopic characteristics shown in FIG. 8, the thickness of the filter is determined as follows. Assuming that $\lambda_{50}$ stands for a desired wavelength having the transmittivity of 50% and $\lambda_0$, a design wavelength of the filter and also that $\lambda_0=4/3\cdot\lambda_{50}$, the thickness of the filter will be $$d_{L1}\times n_L=\lambda_0/4$$

$$d_{H1} \times n_H = \lambda_0/4 \quad (1)$$

where $d_{L1}$ and $d_{H1}$ are the actual thicknesses of the filter at the central area thereof, and $d_{L1} \times n_L$ and $d_{H1} \times n_H$ are effective thicknesses thereof.

For example, when $\lambda_{50}=570$ [nm], $n_L=1.45$ ($SiO_2$) and $n_H=2.31$ ($TiO_2$), $d_L$ will be 131 [nm] and $d_H$ will be 82 [nm]. Then the desired characteristics will be obtained when N=3 to 7.

The thickness of the filter at the peripheral areas thereof is determined as follows. As shown in FIG. 1, a chief light beam 17 is incident onto the interference filter 14 at angle $\Theta_2$ at the peripheral area of the filter. The chief beam 17 is a beam which exists nearly at the center of the effective light flux and is assumed to pass through the center of the incident pupil position 15. The effective thicknesses of the L-layers and H-layers of the filter for the chief beam will be $$n_L \times d_{L2} \cos \Theta_L,$$

$$n_H \times d_{H2} \cos \Theta_H \quad (2)$$

where $d_{L2}$ and $d_{H2}$ are the actual thicknesses of the layers at the peripheral area of the filter, and $\Theta_L$ and $\Theta_H$ stand for angles at which the chief beam passes through the L-layers and H-layers. If the face plate 6 has a refractive index $n_f$, the following relationship will be established:

$$n_f \sin\Theta_2 = n_L \cdot \sin\Theta_L = n_H \cdot \sin\Theta_H \quad (3)$$

If $d_{L2}$ and $d_{H2}$ are equal to $d_{L1}$ and $d_{H1}$ as in the conventional filter, the effective thicknesses will be reduced according to the equation (2). The condition in the equation (1), i.e., the effective thickness should be equal to $\lambda_0/4$, will not be satisfied, and the desired wavelength to $\lambda_{50}$ will become shorter compared with that at the central areas of the filter. As a result, the transmittivity will be reduced as described above.

Therefore, to secure the desired characteristics, the chief beam should satisfy $$n_L \cdot d_{L2} \cdot \cos\Theta_L = \lambda_0/4,$$

$$n_H \cdot d_{H2} \cdot \cos\Theta_H = \lambda_0/4 \quad (4)$$

as in the equation (1). From the equations (1) and (2), the actual thickness should satisfy the equation (5).

$$d_{L1} = d_{L2} \cos \Theta_L$$

$$d_{H1} = d_{H2} \cos \Theta_H \quad (5)$$

As can be seen from the equation (5), the thickness $d_{L2}$ and $d_{H2}$ should be increased at the peripheral area compared with that at the central area as the angle $\Theta_2$ becomes larger.

Since the number N of the superimposed L- and H-layers is the same throughout the whole area, the thickness $t_2$ of the filter is larger than $t_1$ ($t_2 > t_1$), as shown in FIG. 1.

Figure 8:
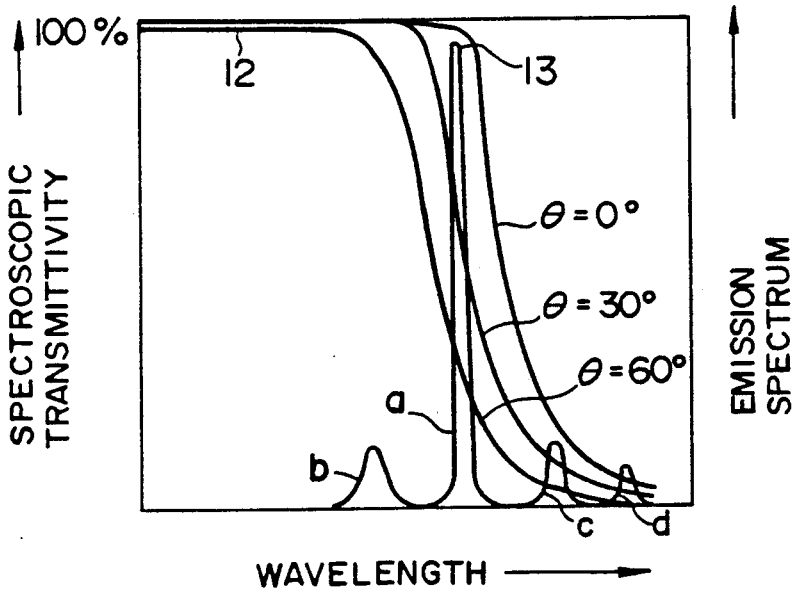
FIG. 8 shows a graph representing spectroscopic characteristics of the interference filter and emission spectrum of the fluorescent material.
Figure 9A:
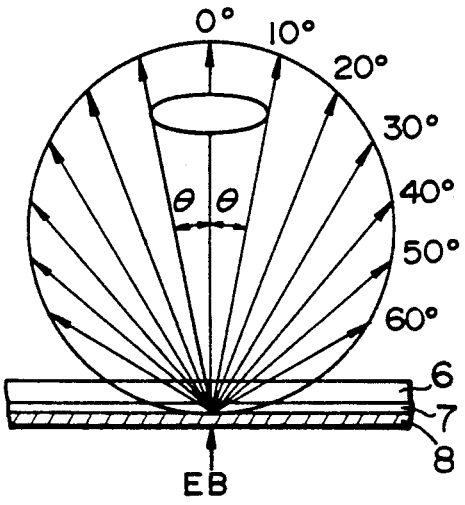
FIGS. 9(*a*) and 9(*b*) respectively show the manner in which the interference filter works.
Figure 9B:
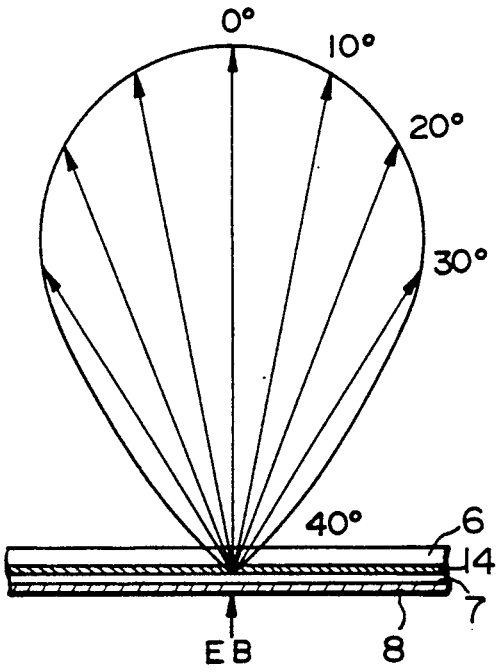

As the thickness of the layers is gradually increased from the central area toward the peripheral area of the filter to meet the equation (5), the chief beam always has the nominal spectroscopic characteristics $\Theta=0°$ as illustrated in FIG. 8. This means that the image is not darkened at the peripheral area of the filter as in the case of the conventional CRT and that a brighter image can be produced over the central and peripheral areas of the CRT.

Figure 6:
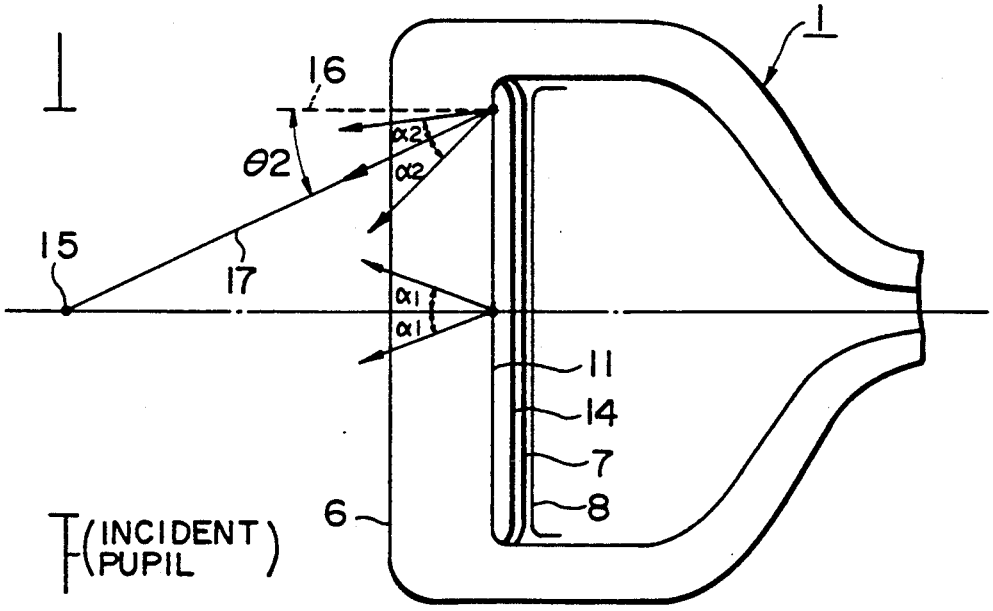
FIG. 6 PRIOR ART
FIGS. 6 and 7 are cross-sectional views showing two different conventional cathode ray tubes each having interference filters.
Figure 7:
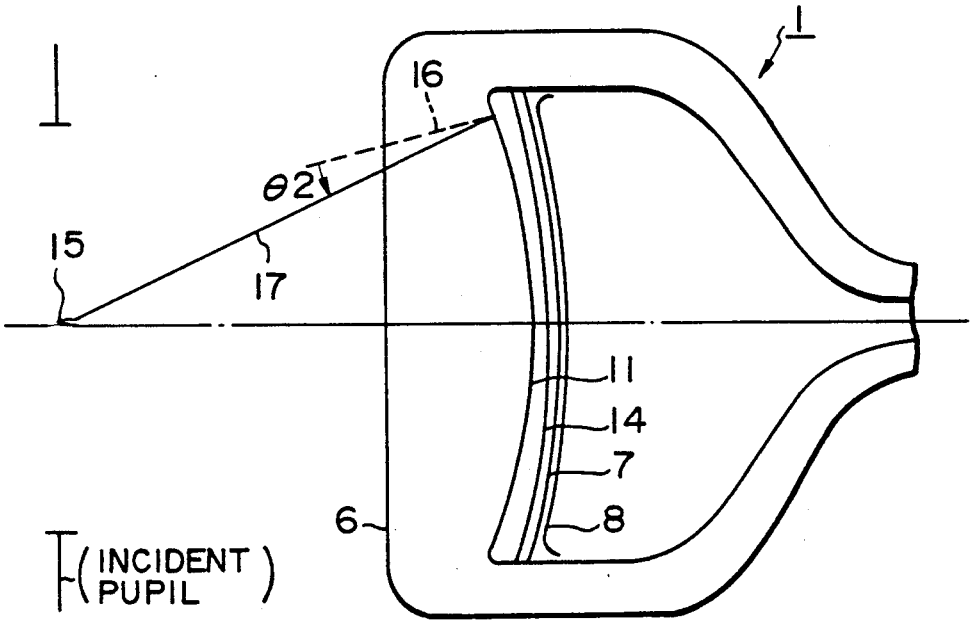
FIG. 7 PRIOR ART

In the illustrated embodiment, the face plate 6 is curved by way of example. This concept is also applicable to a flat face plate as shown in FIG. 6. The thickness of the filter may be varied at positions so as to satisfy the equation (5). Both the filter for the flat face plate and the filter for the curved face are advantageous in the same manner.

If the filter is formed so that the center of radius of the curvature aligned with the center of the incident pupil position 15, the angle $\Theta_2=0°$, and the filter may be uniformly thick over the whole area thereof.

In the embodiment, the high-refractive-index layers (H-layer) comprise titanium oxide ($TiO_2$) for example, or may comprise tantalum oxide ($Ta_2O_5$) for example. In addition, the regulating layers 18 are dispensable.

Figure 3:
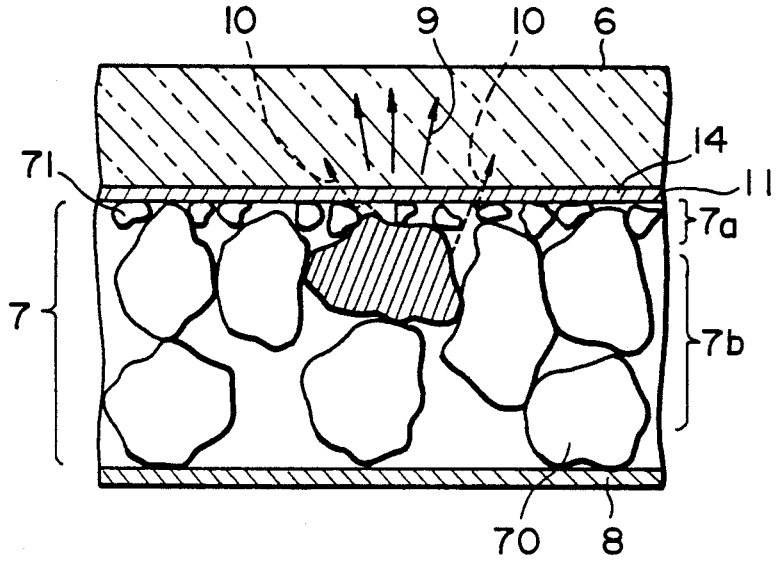
FIG. 3 is a fragmentary enlarged cross-sectional view of a fluorescent layer showing the configuration thereof.
Figure 4:
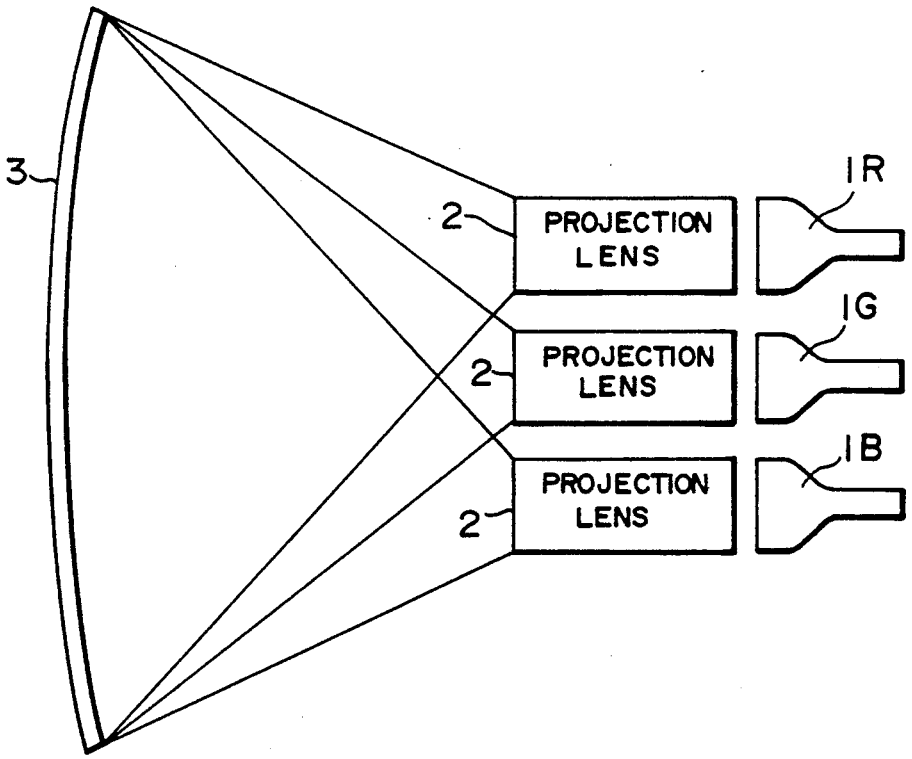
FIG. 4 is a view showing the configuration of a typical video projector.
Figure 5:
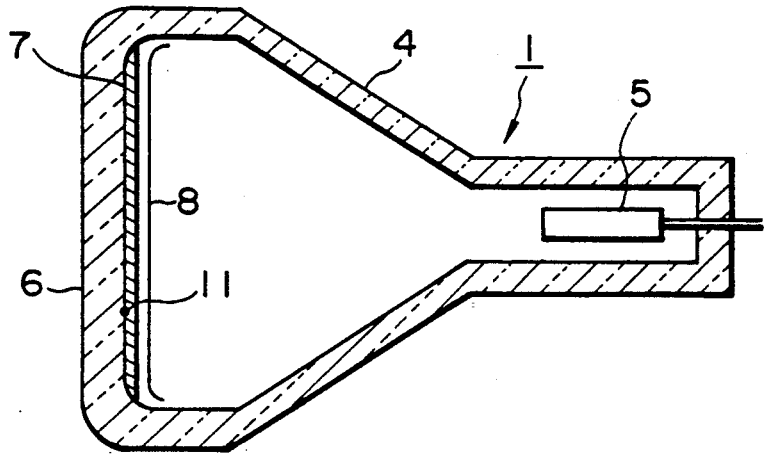
FIG. 5 PRIOR ART
FIG. 5 is a cross-sectional view of a conventional projection cathode ray tube.

The manner in which halo is controlled will be now described with reference to FIG. 3. The interference filter 14 is disposed on the boundary 11 between the face plate 6 and the fluorescent layer 7. A first fluorescent layer **7*a* comprises fluorescent particles 71 having a diameter of about 5 μm which is superimposed on the interference filter 14. A second fluorescent layer 7*b* comprises fluorescent particles 70** having a diameter of about 8 to 20 μm.

The first fluorescent layer **7*a* is as thick as the diameter of the fluorescent particles 71, and is thinner than the second fluorescent layer 7*b*. The fluorescent particles 71 are sparsely applied, with gaps therebetween as large as the diameter of the fluorescent particles 71**.

Figure 10:
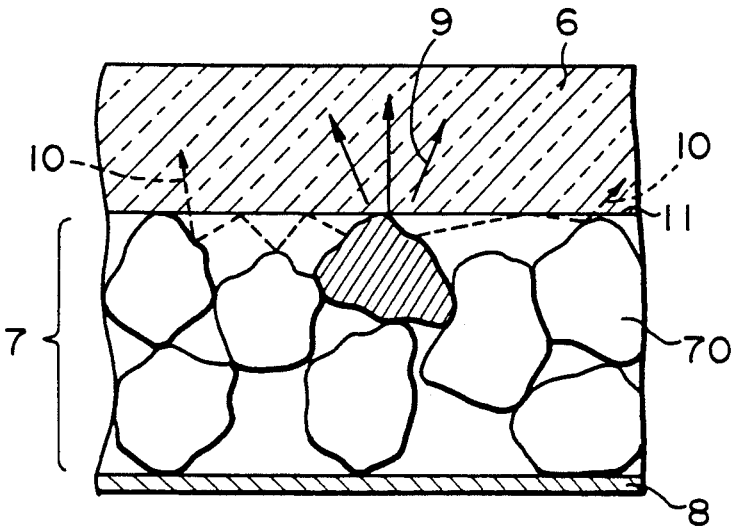
FIG. 10 PRIOR ART
FIG. 10 is a cross-sectional view showing the configuration of the fluorescent layer of the conventional cathode ray tube.
Figure 11:
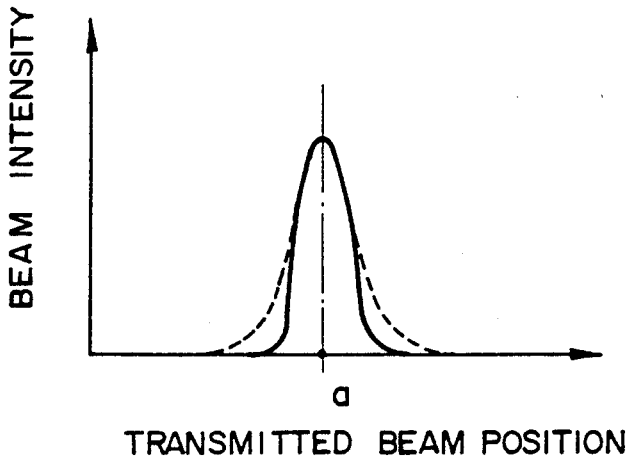
FIG. 11 PRIOR ART
FIG. 11 shows intensity distribution of a luminous spot in the conventional cathode ray tube.

The second fluorescent layer **7*b* corresponds to the fluorescent layer 7 in the conventional CRT illustrated in FIG. 10. The fluorescent particles 71 forming the first layer 7*a* fill the vacuum gaps existing between the second fluorescent particles 70 and the boundary 11**.

The manner in which halo is controlled will now be described in connection with the fluorescent particle 70 that is indicated by oblique lines.

Light beams, not illustrated, pass through the vacuum evaporation aluminum film 8 and excite the fluorescent particles 70 in the second layer **7*b*, thus making the particles 70** luminous.

Light beams 9 in the luminous light flux reach the face plate 6 through gaps between the fluorescent particles 70, and are used for image signals.

However, since the fluorescent particles 70 produce light beams in multiple directions, there are light beams 10 which are reflected by the boundary 11 beside the face plate 6. In this embodiment, the small fluorescent particles 71 fill the gaps between the fluorescent particles 70 near the boundary 11. The light beams 10 reflected by the boundary 11 do not spread into the gaps between the second fluorescent particles 70, but are scattered and reflected by the fluorescent particles 71, thereby minimizing halo 10 sharply.

The large fluorescent particles 70 in the second layer **7*b* mainly contribute luminescence, and assure an of the conventional system. Further, the first layer 71 is in the prior art. Further, the first layer 71 are made of the small fluorescent particles 7*a* having a 5 μm diameter which are as thick as the diameter of the particles 71. The fluorescent particles 7*a* are sparsely applied with suitable gaps therebetween, and sufficiently pass light beams which are made luminous by the second layer 7*b***, thereby preventing the quantity of light beams from being reduced.

The interference filter 14 is effective especially for a projection cathode ray tube, retarding the increase of halo caused by beams which have large incident angles and increased reflection index.

According to this invention, since the actual thickness of the interference filter is gradually increased toward the periphery of the filter so that the effective thickness of the filter for the chief beam should be $\lambda_0/4$, a CRT can produce the bright image from the central area to the peripheral area thereof.

Further, the fluorescent layers made of two kinds of fluorescent particles having different diameters can control halo which is caused by light beams which are reflected multiple times between the face plate and the large fluorescent particles. Therefore, a finer image can be produced by the projection cathode ray tube according to this invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A projection cathode ray tube including an interference filter formed between an inner surface of a face plate and fluorescent layers of the projection cathode ray tube, wherein the inner surface of the face plate is concave toward an outer surface, and the interference filter comprises:

a multilayered structure of superimposed layers including a first filter layer having high refractive index and N alternating layers of second and third filter layers having low and high refractive indexes, respectively, wherein N is an integer such that ($3 \leqq N \leqq 7$), the thickness of the interference filter varying along said inner surface of said face plate and being determined so that $n_k.d_k.\cos\Theta_k$ is equal for any chief beam on an arbitrary position on said filter layers from center to corner, wherein $n_k$ represents the refractive index of k-th layer, $\Theta_k$ represents the incident angle of the chief beam existing in the center of an effective light flux and passing through the center of an entrance pupil of a projection lens, and $d_k$ represents a thickness of the k-th layer.

2. The projection cathode ray tube according to claim 1, wherein the center of radius of curvature of the inner surface of the face plate is aligned with the center of an entrance pupil position of the projection lens.

3. The projection cathode ray tube according to claim 1, wherein a regulating layer is sandwiched between the face plate and said filter layers.

4. The projection cathode ray tube according to claim 1, wherein said first filter layer has high refractive index and comprises titanium oxide ($TiO_2$) or tantalum oxide ($Ta_2O_5$).

5. A projection cathode ray tube including an interference filter formed between an inner surface of a face plate and fluorescent layers of the projection cathode ray tube, wherein the fluorescent layers comprise:

(a) a first fluorescent layer of small fluorescent particles contacting the interference filter, said first fluorescent layer of a thickness equal to a diameter of said small fluorescent particles; and (b) a second fluorescent layer of large fluorescent particles disposed on a surface of said first fluorescent layer remote from said face plate.

6. The projection cathode ray tube according to claim 5, wherein a size of gaps between said small fluorescent particles of said first fluorescent layer are approximately equal to the diameter of said small fluorescent particles.

7. The projection cathode ray tube according to claim 5, wherein said small fluorescent particles of said first fluorescent layer fill vacuum gaps between said large fluorescent particles of said second fluorescent layer and said interference filter.

8. The projection cathode ray tube according to claim 1 including a fluorescent layer, disposed on a surface of said interference filter opposite the inner surface of said face plate, for generating said light beams when excited by electron beams incident thereto from an electron gun.

9. The projection cathode ray tube of claim 8, wherein said interference filter is of a first thickness near a central portion of said face plate and of a second thickness, greater than said first thickness, near a periphery of said face plate.

10. The projection cathode ray tube of claim 8, wherein said fluorescent layer comprises:

a first fluorescent layer of small fluorescent particles disposed adjacent said interference filter, said first fluorescent layer of a thickness equal to a diameter of said small fluorescent particles; and a second fluorescent layer of large fluorescent particles disposed on a surface of said first fluorescent layer opposite said interference filter.

11. The projection cathode ray tube of claim 10, wherein said small fluorescent particles of said first fluorescent layer fill vacuum gaps between said large fluorescent particles of said second fluorescent layer.

* * * * *